United States Patent [19]

Kubata et al.

[11] Patent Number: 4,880,183

[45] Date of Patent: Nov. 14, 1989

[54] TUBE WITH YARN CATCH PLACE

[75] Inventors: Milan Kubata; Jiri Soukup; Jiri Trhlik, all of Usti nad Orlici, Czechoslovakia

[73] Assignee: Flitex, Liberec, Czechoslovakia

[21] Appl. No.: 239,088

[22] Filed: Aug. 31, 1988

[30] Foreign Application Priority Data

Sep. 1, 1987 [CS] Czechoslovakia ..... 6350-87

[51] Int. Cl.[4] ..... B65H 75/28

[52] U.S. Cl. ..... 242/125.1; 242/18 PW

[58] Field of Search ..... 242/125.1, 125, 125.2, 242/18 PW, 18 A

[56] References Cited

U.S. PATENT DOCUMENTS

| | | | |
|---|---|---|---|
| 3,814,347 | 6/1974 | Moren, Jr. | 242/125.1 |
| 4,050,645 | 9/1977 | Burchette, Jr. et al. | 242/18 PW X |
| 4,050,646 | 9/1977 | Burchette, Jr. | 242/18 PW |
| 4,101,086 | 7/1978 | Thomas, Jr. | 242/125.1 X |

FOREIGN PATENT DOCUMENTS 1475104 6/1977 United Kingdom .

*Primary Examiner*—Stanley N. Gilreath
*Attorney, Agent, or Firm*—Klein & Vibber

[57] ABSTRACT

The invention relates to a tube with a yarn catch place for winding yarn on textile machine equipped with at least one yarn catch place for catching yarn and starting the bobbin winding.

The yarn catch place according to the invention is designed as an extended hole with a circumferentially inward extending catch point. The catch point is oriented in the direction of rotation of the tube and arranged such that an imaginary line connecting the two most distant circumferential points of the hole passes under the catch point. The catch place can be added to existing tubes and does not interfere with unwinding of yarn.

5 Claims, 1 Drawing Sheet

TUBE WITH YARN CATCH PLACE

FIELD OF THE INVENTION

The invention relates to a cylindrical body, especially to a tube for winding yarn on an open-end spinning machine, provided near at least one of its ends with at least one catch place for yarn and, as the case may be, with a narrow circumferential surface for depositing the yarn bunch. The yarn catch place features a point oriented in relation to the direction of revolution of the tube and made as a part of the cylindrical body.

BACKGROUND OF THE INVENTION

Known yarn carrier tubes are described, for example, in the Czechoslovak patent specification No. 174,998 and in the U.S. Pat. No. 4,050,645. These known yarn carriers impose exacting requirements on their production due to the complicated shape of the yarn catch place that can be made on one side of the tube only because the two-side version causes yarn ruptures in the process of yarn unwinding from the bunch.

Another known embodiment, described in the U.S. Pat. No. 4,050,646, is provided with two yarn catch places, i.e., on each tube side, and thus permits the tubes to be laid into the spool frame unoriented. A substantial drawback, however, consists in the weakening of the tube edges and in increased risk of damaging the yarn catch member when handling the spools and tubes. Broken off yarn catch members fail to fulfill their function, and small damages lead to an increased rupture rate in the process of spool rewinding.

In yet another known embodiment, described in the U.S. Pat. No. 3,814,347, the yarn catching member is both difficult to produce and easily damaged.

It is an object of the present invention to create a tube with at least one yarn catch member and with a deposit surface for the yarn bunch maintaining the advantages of the known tubes with respect to the yarn bunch formation with simultaneous winding and having yarn catch places that can be easily produced on each tube side and fulfilling the condition that those of them that do not participate in catching the yarn do not cause the yarn ruptures when the yarn is wound-off for further processing.

INCORPORATION BY REFERENCE

To facilitate understanding of the present invention, the complete disclosures of the above-mentioned U.S. Patents are incorporated herein by reference.

SUMMARY OF THE INVENTION

On the tube according to the present invention, the yarn catch place on the cylindrical body of the tube is an extended, radially oriented hole situated so that a straight line connecting the two of its circumferential points that are most spaced from each other passes under a point reaching into the zone of this extended hole.

The invention permits a yarn catch place that can be easily produced, even subsequently on tubes produced previously, to wind a yarn bunch across the yarn catch place without preventing the yarn from being wound-off. Moreover, the invention allows producing the yarn catch places on both tube ends, thus permitting insertion of the tubes into the spool frame without giving them a predetermined orientation. In addition, the inventive yarn tube is made so that the yarn catch places not participating in the yarn catching do not prevent it from being wound-off.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENT

Figure 1:
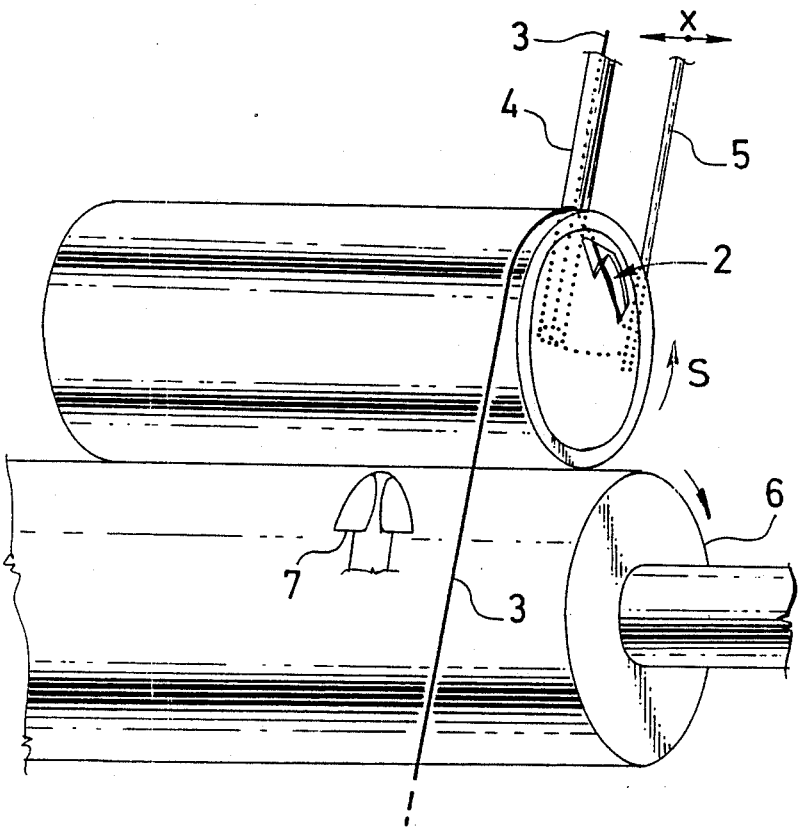
FIG. 1 is a general axonometric view of the tube.
Figure 2:
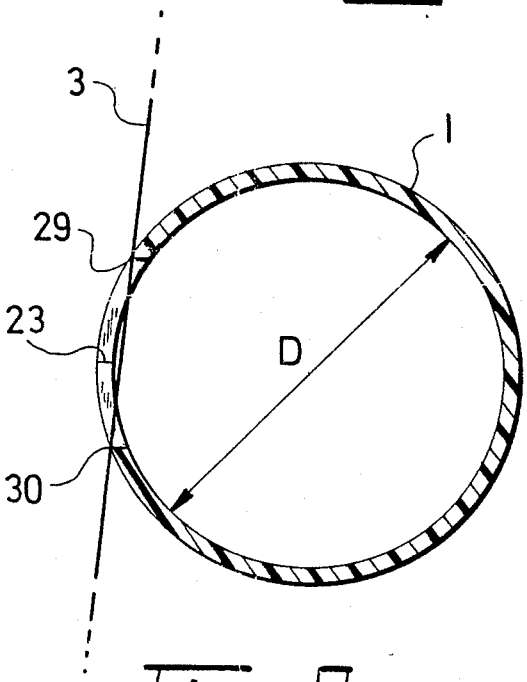
FIG. 2 is a section of the tube in the yarn catch place.
Figure 3:
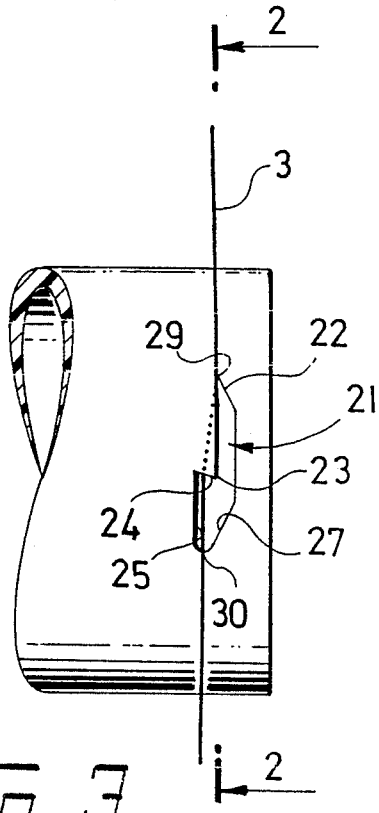
FIG. 3 is a view of the yarn catch place.

Referring to the figures generally, the tube 1 is provided with a yarn catch place 2. The catch place 2 comprises an extended hole 21 with a "yarn catch member" comprising a point 23 oriented in the direction of rotation S of the tube. The outer surface of the yarn catch member is made as a part of the tube 1, and the sides 24, 25 of the point 23 form an acute angle. Slanting edges 22 and 27 of hole 21 help the yarn 3 enter under the point 23 as seen in FIG. 3.

The yarn catch place 2 on the cylindrical body of the tube 1 is an extended, radially oriented hole situated so that a straight line connecting the two of its circumferential points that are most spaced from each other 29, 30 passes under point 23 reaching into the zone of this extended hole 21.

The invention permits a yarn catch place that can be easily produced, even subsequently on tubes produced previously, to wind a yarn bunch across the yarn catch place without preventing the yarn from being wound-off. Moreover, the invention allows producing the yarn catch places on both tube ends, thus permitting insertion of the tubes into the spool frame without giving them a predetermined orientation. In addition, the inventive yarn tube is made so that yarn catch places not participating in the yarn catching do not prevent the yarn from being wound-off.

MANNER OF OPERATION

The described embodiment of the invention operates as follows:

After the completion of winding on a preceding tube 1, the tube is removed by a not shown automatic service device. After the separation of the yarn 3 coming, e.g., from a not shown spinning unit of an open-end spinning machine, the end of the yarn 3 is sucked by a suction tube 4 so as to permit the spinning unit to run uninterruptedly. Another tube 1 is then inserted into the not shown spool frame. The suction tube 4 transports the yarn 3 to the tube 1 where it is, by means of a lateral displacement of an ancillary guide 5, displaced so as to be introduced into the extended hole 21. The yarn 3 is caught by the point 23, transported to a point between the tube 1 and winding roller 6, begins to be wound on, gets caught by guide 7 and evenly distributed on the tube 1 by the rectilinear reverse motion of the latter. The ancillary guide 5 keeps its position over the yarn catch place, and the yarn 3 drawn out from the suction tube 4 is wound in the form of a bunch on the edge of the tube 1.

When unwound on a processing machine, e.g., on a warping frame, the yarn 3 disengages with the yarn catch place 2. Following that, the bunch and the yarn 3 of the next spool, connected with it, is unwound.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. An improved tube for winding yarn on open-end spinning machines, provided near at least one of its ends with at least one catch place for yarn, the improvement comprising the yarn catch place having a catch point oriented in the direction of rotation of the tube and formed as a part of the tube, and the yarn catch place being radially oriented extended hole having two most distant circumferential points connected by two side wall, said catch point extending from one of said side walls such that a straight line connecting the two most distant circumferential points of said hole passes under the catch point;

the side wall opposite said catch point being provided with slanting lead-in edges at said most distant circumferential points.

2. An improved tube as claimed in claim 1, wherein said catch point is formed by two edges forming an acute angle.

3. An improved tube for winding yarn on open-end spinning machines, provided near at least one of its ends with at least one catch place for yarn, the improvement comprising the yarn catch place comprising a radially oriented hole having two most distant circumferential points connected by two sidewalls;

one of said sidewalls comprising three substantially straight segments, an inner segment and two outer segments, each outer segment forming an obtuse angle with said inner segment;

the other of said sidewalls comprising a catch point whereby a straight line connecting the two most distant circumferential points of said hole passes under the catch point.

4. A tube as claimed in claim 3 wherein the catch point is formed by two edges forming an acute angle.

5. A tube as claimed in claim 3 wherein said other sidewall comprises three segments in a substantially Z-shaped arrangement to form said catch point.

* * * * *